US007584866B2

(12) United States Patent
Selina et al.

(10) Patent No.: US 7,584,866 B2
(45) Date of Patent: Sep. 8, 2009

(54) ALL PLASTIC PAINT CONTAINER

(75) Inventors: John Robert Selina, Brighton, MI (US); Matt Norton, Royal Oak, MI (US)

(73) Assignee: Letica Corporation, Rochester, MI (US)

( * ) Notice: Subject to any disclaimer, the term of this patent is extended or adjusted under 35 U.S.C. 154(b) by 433 days.

(21) Appl. No.: 11/499,452

(22) Filed: Aug. 4, 2006

(65) Prior Publication Data

US 2008/0029559 A1 Feb. 7, 2008

(51) Int. Cl.
*B65D 5/72* (2006.01)

(52) U.S. Cl. ..... 220/698; 220/700; 220/790; 222/570

(58) Field of Classification Search ..... 222/567, 222/570, 572, 465.1, 254.7, 256.1; 220/703, 220/359.1, 613, 617, 621, 636, 783, 359.2, 220/698, 700, 790

See application file for complete search history.

(56) References Cited

U.S. PATENT DOCUMENTS 2,837,256 A * 6/1958 Daner ..... 222/568
3,913,785 A * 10/1975 Pattershall ..... 220/733
4,293,080 A 10/1981 Letica ..... 220/306
4,349,119 A 9/1982 Letica ..... 220/306
4,356,930 A * 11/1982 Roper ..... 220/783
4,667,843 A 5/1987 Galer
5,660,302 A 8/1997 Trout ..... 220/790
5,799,813 A * 9/1998 Letica ..... 220/254.1
6,588,618 B1 7/2003 Davis
7,134,576 B2 * 11/2006 Gringer et al. ..... 222/143
2004/0026450 A1 * 2/2004 Rohr et al. ..... 222/109
2006/0043095 A1 * 3/2006 Maholm et al. ..... 220/701
2006/0255040 A1 * 11/2006 Woinarski ..... 220/276

* cited by examiner

*Primary Examiner*—Kevin P Shaver
*Assistant Examiner*—Michael Hagedorn
(74) *Attorney, Agent, or Firm*—Young Basile

(57) ABSTRACT

An all plastic paint container comprising the combination of a cylindrical pail, a separate snap-on pouring spout ring and a separate snap on lid having a tear band which must be removed before manual access to the edge of the lid for removal purposes can be realized. The mechanical attachments between the pouring ring and the pail and between the lid and the pouring ring are achieved by inverted U-shaped channels and under cuts which provide the snap on mechanical associations.

12 Claims, 5 Drawing Sheets

ALL PLASTIC PAINT CONTAINER

FIELD OF THE INVENTION

This invention relates to plastic containers and particularly to a plastic container suitable for use in merchandising paint wherein the container comprises the combination of a cylindrical plastic pail having an upper annular rim, a semi-toroidal spout ring which snaps on to the annular pail rim, and a lid which snaps on to the spout ring.

BACKGROUND OF THE INVENTION

Paint was for many years typically retailed in metal cans having metal lids which fit on to the rim of the can in what might be called a tongue and groove fit. There are a number of disadvantages associated with metal paint cans including cost, and the difficulties associated with pouring paint from the can; i.e., paint inevitably fills the groove in the can rim and makes it difficult and messy to reapply the lid to provide an airtight seal.

Various efforts have been made to design and construct plastic pails suitable for use in merchandising paint and other similar products. Examples of such plastic containers are disclosed in U.S. Pat. Nos. 4,293,080 and 4,349,119, both entitled "Container Construction" issued Oct. 6, 1981 and Sep. 4, 1982 to Ilija Letica and assigned to Letica Corporation. Both patents disclose a container comprising the combination of a cylindrical pail and a snap-on closure.

SUMMARY OF THE INVENTION

The present invention provides an all plastic container for paint and similar products comprising the combination of a cylindrical pail, an annular spout ring and a closure or lid which snaps onto the spout ring. The pail has an upper annular rim and the annular spout ring snaps onto the annular pail rim to provide a secure mechanical connection between the two components. The spout ring, in the preferred embodiment illustrated herein, is semi-toroidal in shape and terminates in an upper annular pouring rim which is of a smaller diameter than the pail rim. The lid in the preferred embodiment is essentially bowl-shaped and has an inner, inverted U-shaped channel or groove which snaps onto the pouring rim of the spout. The lid further has an outer skirt which substantially matches the outer diameter of the pail.

In the preferred embodiment the lid skirt incorporates a tear band; i.e., a feature which permits a portion of the skirt or side wall of the lid to be permanently removed without the use of tools. Prior to the removal of the tear band, the side wall of the lid fits in a closely abutting and essentially flush relationship with the side wall of the pail to provide a continuous and aesthetically pleasing appearance as well as a level of security by making it difficult to grip the lid with sufficient leverage to remove it. However, removing the tear band provides ready manual access to the resulting undersurface of the lid edge so that the lid may be readily manually removed for access to the content of the pail. Removal of the tear band does not remove any of the locking feature between the rim and the pouring spout. Therefore, the lid may be re-secured to the pouring spout/container combination with essentially the same tightness and security as in the original unaltered combination.

In the preferred embodiment the tear band is provided with a ridged tear tab which fits into a slotted opening in the lid side wall. In addition, the lid is provided with a central well area which contains a tint plug which can be removed to add tinting ingredients to the paint in the pail without removing the primary lid.

Various additional features and advantages of the invention will be appreciated from the following description which is to be taken with the accompanying drawings.

DETAILED DESCRIPTION OF THE ILLUSTRATIVE EMBODIMENT

Figure 1:
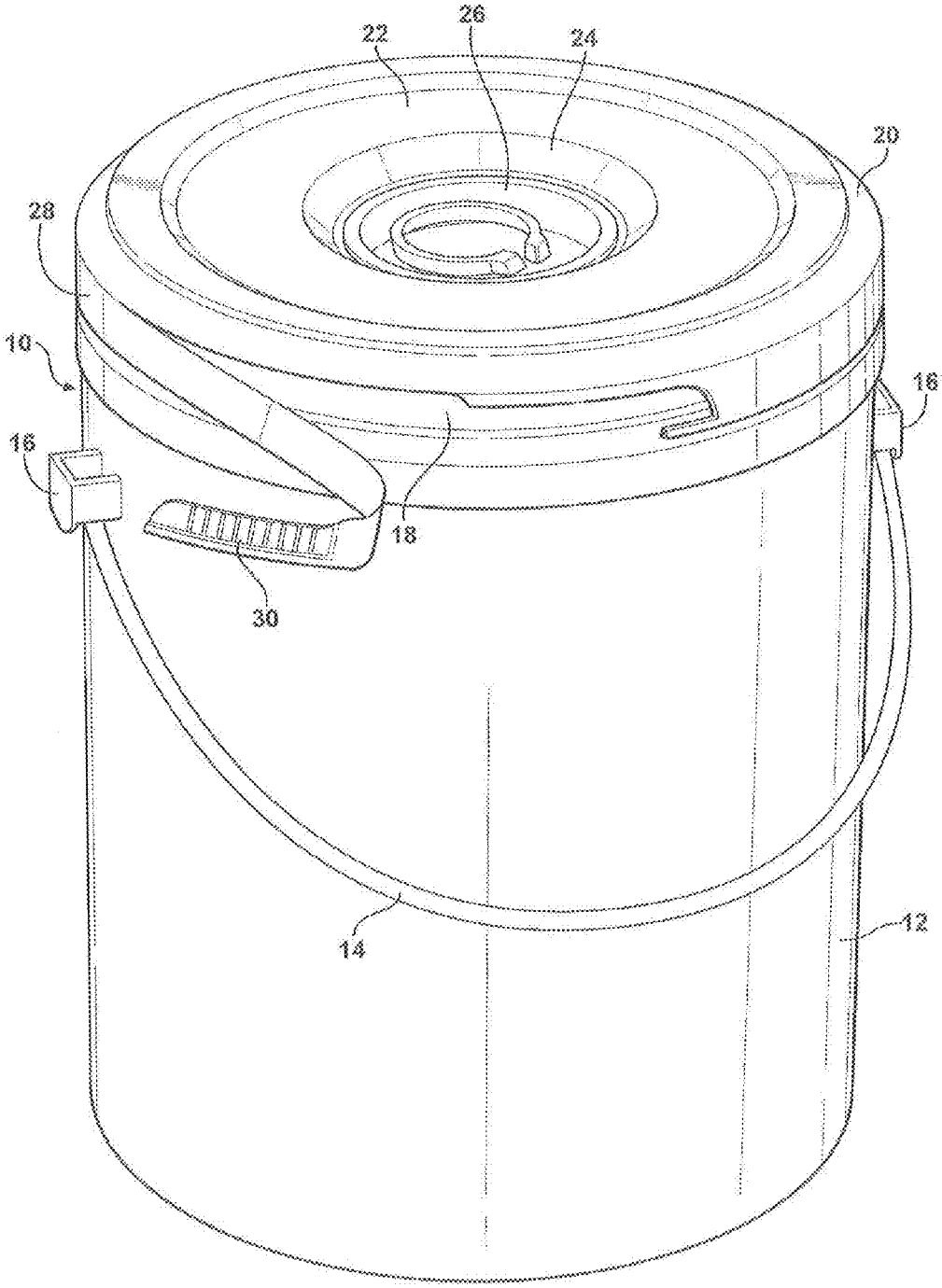
FIG. 1 is a perspective view of an all plastic paint container embodying the invention.
Figure 2:
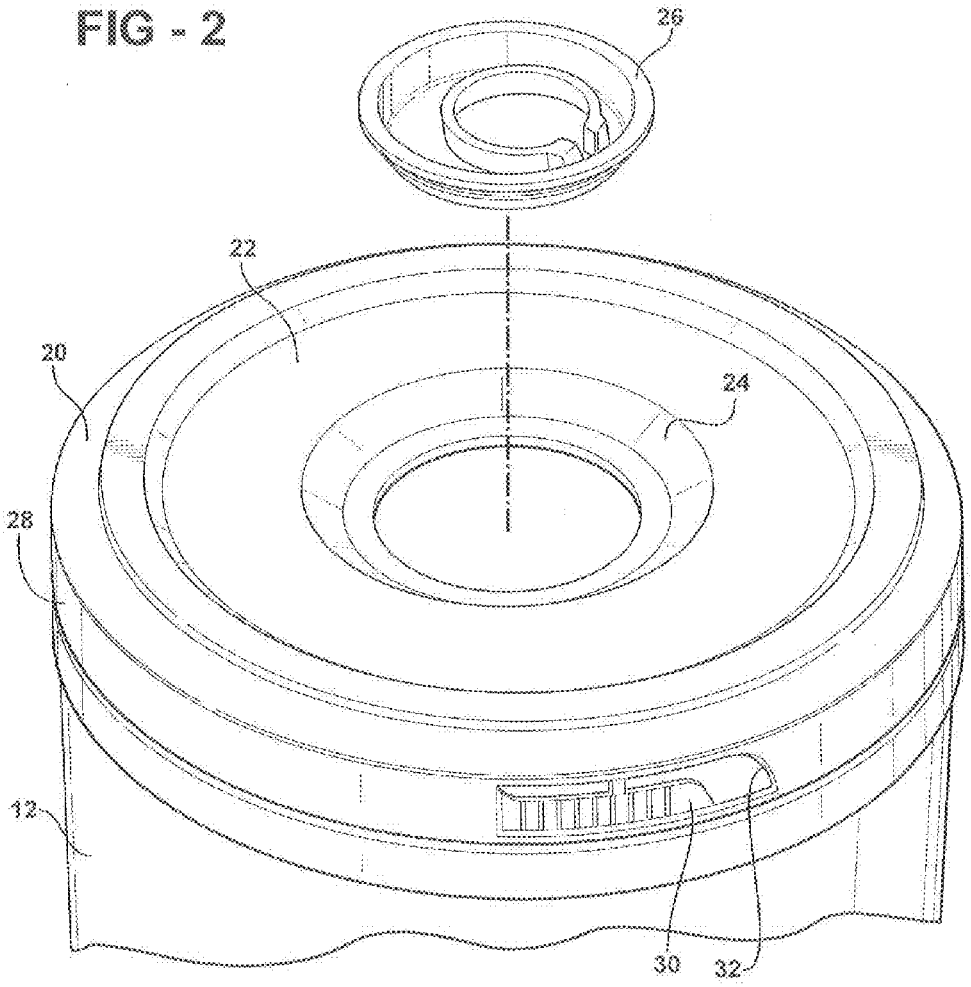
FIG. 2 is a perspective view of the top portion of the paint container shown in FIG. 1 with the tint plug removed from the lid.

Referring now to FIGS. 1 and 2, there is shown an all plastic container 10 for paint and other similar products comprising the combination of a cylindrical plastic pail 12 having a bail 14 attached to bail ears 16, a semi-toroidal, annular spout ring 18 which snaps onto the top rim of the pail and a bowl-shaped lid 20 which snaps onto the annular spout ring 18. The lid may have a central recess 22 within which is formed a well 24 to receive a tint plug 26. The tint plug 26 may be constructed in various ways including the constructions shown in U.S. Pat. Nos. 5,799,813 and 5,660,302. The lid is provided with a weakened area 32 which defines a side wall tear band 28 terminating in a ridged tear tab 30 which fits within a notched out area 32 in the side wall as best shown in FIG. 2. The tab 30 is grasped with the fingers to remove the tear band.

Figure 3:
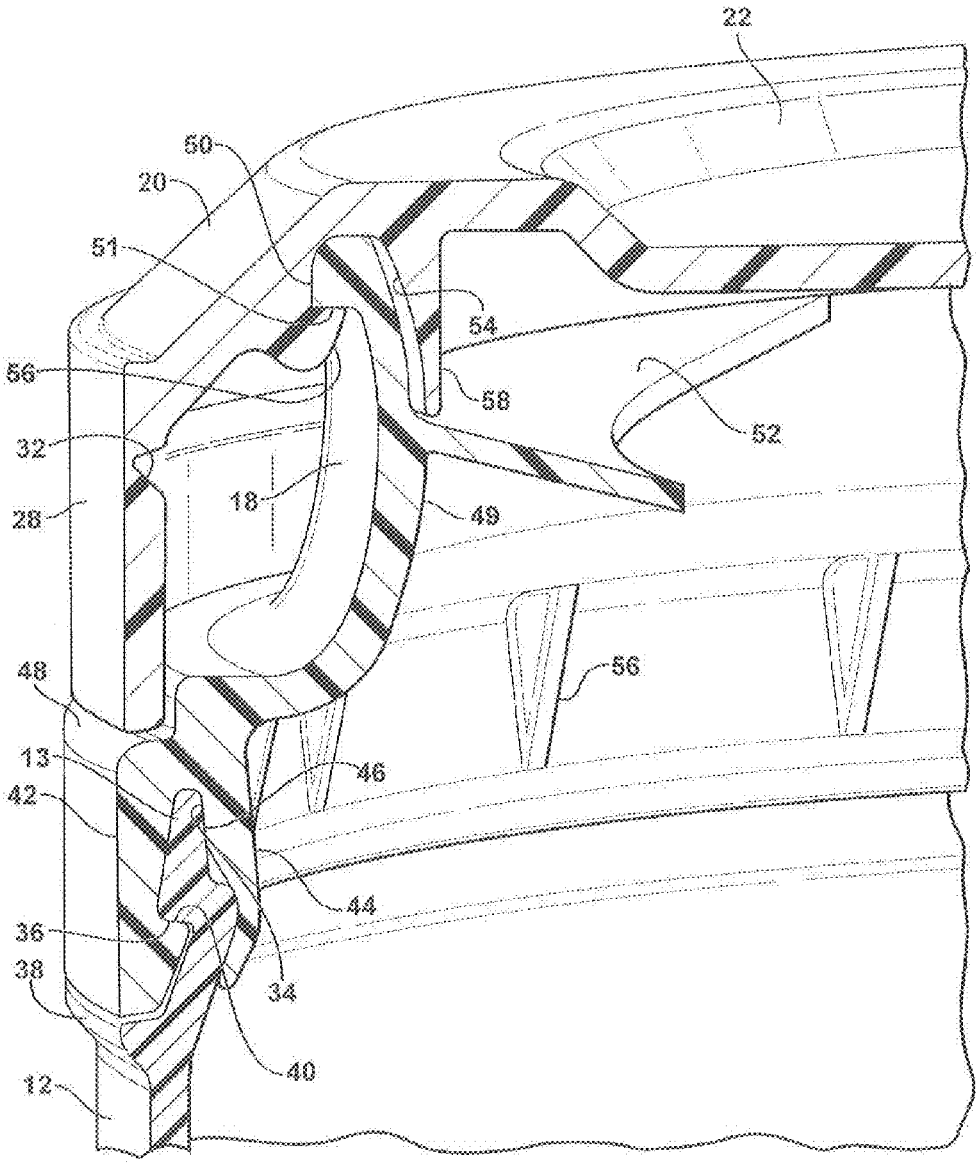
FIG. 3 is a perspective view partly in section of the upper portion of the container of FIG. 1 showing the relationship between the container, the pouring spout and the lid with the tear band in place.
Figure 4:
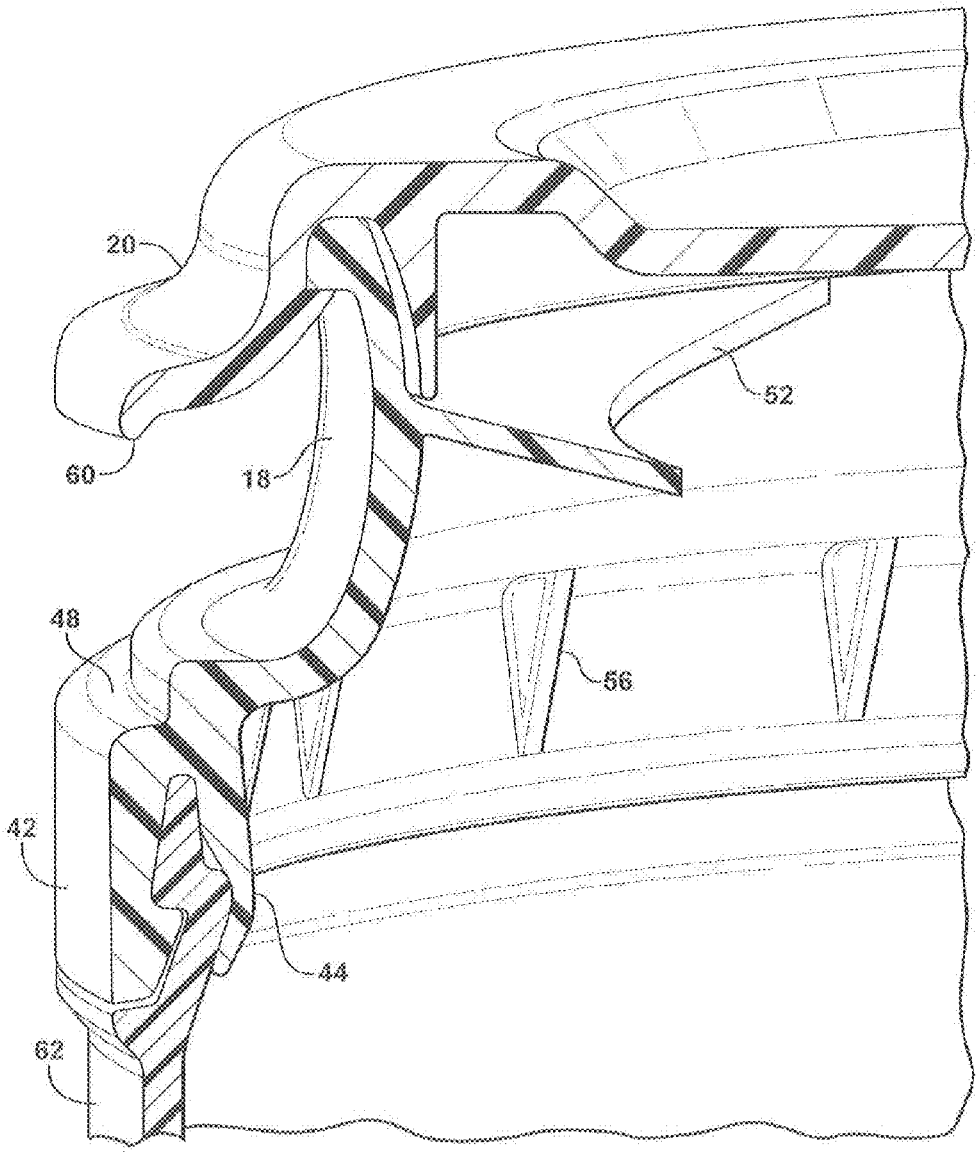
FIG. 4 is a perspective view partly in cross-section of the structure of FIG. 3 after removal of the tear band.

Turning now to FIGS. 3 and 4 the details of the container 10 shown in FIGS. 1 and 2 will be described in detail. The pail 12 terminates in an upper annular rim 13 having an external undercut 36 just below the top of the rim 13 and, below the undercut 36, an external annular shoulder 38. An internal shoulder 40 is located just above the outer undercut 36 as shown in FIGS. 3 and 4. The pouring ring 18 has a base portion characterized by a downwardly depending outer leg 42 and a downwardly depending inner leg 44 defining therebetween an inverted U-shaped channel 46 which receivingly snaps onto the undercut portion of the container rim 13 to provide a mechanically secure and airtight fit. Supplemental adhesive or ultrasonic welding may be used to increase the integrity of the mechanical fit between the pail 12 and the ring 18.

Figure 5:
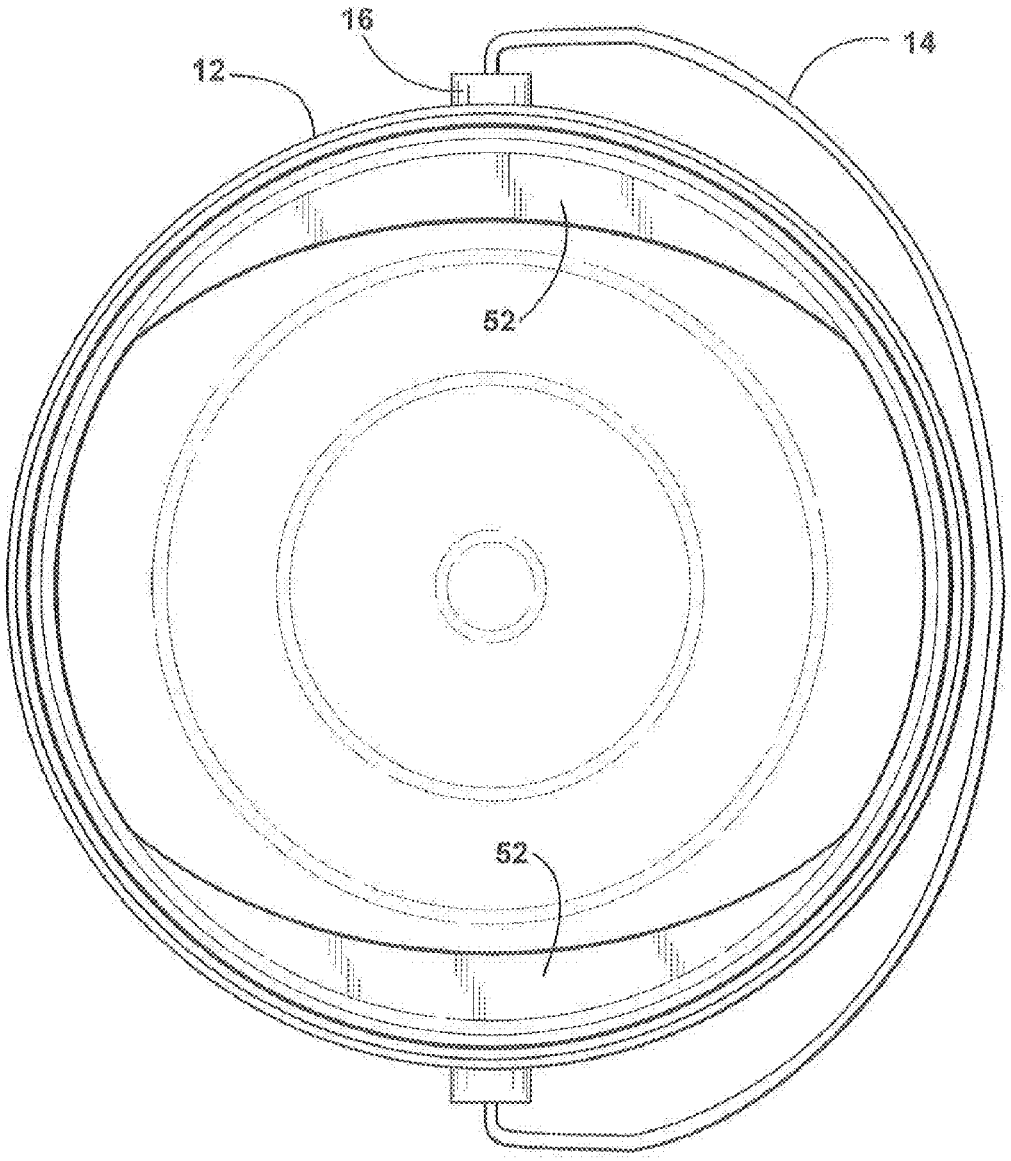
FIG. 5 is a plan view of the container with the lid removed.

The pouring ring 18 exhibits an upper annular shoulder 48 which flows into the inwardly and upwardly curving bell-shaped or "semi-toroidal" portion 49 which terminates in an upper pouring rim 50 having an external undercut 51. Wiper ledges 52 are formed integrally with the bell-shaped portion 49 of the pouring ring 18. As shown in FIG. 5 the wiper ledges 52 do not extend all the way around the interior of the ring, therefore leaving pouring space between the wiper ledges 52 where paint may be conveniently poured from the container after the lid 20 is removed. Reinforcing ribs 56 are formed integrally with the ring 18 to add structural strength and rigidity in the area between the bell-shaped portion 49 and the inner leg 44 defining the inverted U-shaped channel 46. The upper rim 50 of the spout ring is smaller than the diameter of the pail rim 13.

Looking now to the lid 20, it is formed with an inverted U-shaped channel 54 which is approximately 1 to 1¼ inches smaller in diameter than the inverted U-shaped channel 46 of the pouring ring 18. The inverted U-shaped channel is formed by an outer leg 56 which co-acts with the undercut 51 and an inner leg 58 such that the lid 20 snaps onto the upper rim 50 of the pouring rim 18 to secure the contents of the container. No adhesive, ultrasonic welding or other bonding agent is used in the mechanical interconnection between the lid 20 and the pouring ring 18 since it is necessary to be able to remove the lid 20 when the end user desires to make use of the contents of the container.

As also shown in FIGS. 3 and 4 the tear band 28 lies approximately ¾ inch radially outboard of the curved surface of the pouring ring 18 and extends downwardly into a closely abutting relationship with the shoulder 48 so as to make it extremely difficult to place one's fingers or even a prying tool between the bottom edge of the tear band 28 and the shoulder 48 for the purpose of removing the lid 20 until the tear band 28 is physically removed from the lid 20 as shown in FIG. 4. Once the tear band has been removed by grasping the tear tab 30 and pulling the tear band off of the lid 20, there is a substantial space between the resulting exposed edge 60 of the lid 20 (FIG. 4) and the shoulder 48 which makes it very easy to manually remove and reattach the lid while paint is being used.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An all plastic paint container comprising:

a cylindrical pail having an upper annular rim;

an annular spout ring having an inverted U-shaped peripheral portion which snaps onto the annular pail rim and has an upper annular shoulder and, internally of said shoulder, an upstanding pouring rim which rises substantially above the rim and the shoulder when the ring is attached to the pail; and a lid which snaps onto the spout ring pouring rim and has an outer sidewall with a diameter substantially equal to the outer diameter of the ring, said sidewall lying immediately above said shoulder when the lid is attached to the spout ring.

2. An all plastic paint container as described in claim 1 wherein the outer diameter of the lid is substantially equal to the outer diameter of the pail, said lid further including a weakened area on the side wall of the lid which defines a tear band.

3. An all plastic paint container as described in claim 2 wherein the spout ring has an inverted U-shaped channel which receivingly snaps onto the upper annular rim of the cylindrical pail and defines an external shoulder having a diameter approximately equal to that to the diameter of the pail, the lid side wall, with the tear band in place, closely abutting the shoulder when the lid is secured to the spout ring.

4. The all plastic paint container as described in claim 3 wherein the spout ring is semi-toroidal in shape to define upper and lower annular rims, the upper rim being smaller in diameter than the lower rim.

5. The all plastic paint container defined in claim 4 further including wiper ledges formed within the inside surface of the pouring rim.

6. An all plastic paint container comprising:

a pail having an open top defined by a side wall ending in a rim having a first diameter which is moderately less than the diameter of the sidewall, said sidewall also having an external undercut;

a separate snap-on annular spout ring having an inverted U-shaped base channel adapted to receivingly snap on to said pail rim and defining an upwardly facing annular shoulder, said spout ring having a side wall extending upwardly and inwardly from said shoulder and which terminates at the upper end in an annular spout which lies substantially above the rim and shoulder and has a second diameter smaller than the first diameter and having an external undercut; and a bowl-shaped snap on lid having a side wall of substantially said first diameter which rests on or immediately above said shoulder and, radially inwardly of said side wall, an inverted U-shaped channel adapted to receivingly snap on to the upper end of the spout.

7. An all plastic paint container as defined in claim 6 wherein the spout ring has an upwardly facing external shoulder and the lid side wall abuts the shoulder when the lid is attached to the spout ring.

8. The all plastic paint container defined in claim 7 wherein the lid side wall tears off along a line of weakened structure under and radially outwardly of the channel and the outer diameter of the lid is substantially equal to the outer diameter of the pail such that the lid is substantially radially flush with the pail when attached to the spout ring.

9. The all plastic paint container defined in claim 6 wherein the lid has a circular recess.

10. The all plastic paint container defined in claim 6 wherein the spout ring is provided with at least one brush wiper.

11. The all plastic paint container as defined in claim 10 wherein the spout ring is provided with a pair of opposing brush wipers.

12. The all plastic paint container as defined in claim 9 further including a tint plug located within the recess.

* * * * *